US007861702B1

(12) United States Patent
Sze

(10) Patent No.: US 7,861,702 B1
(45) Date of Patent: Jan. 4, 2011

(54) GAS AIR OPERATED WITH DRAW BACK BORING TOY LONG-BARRELLED GUN

(76) Inventor: Yat Ming Sze, Room 23-B, Yan On Bldg, 1 Kwong Wa Street, Kowloon, Hong Kong (HK)

( * ) Notice: Subject to any disclaimer, the term of this patent is extended or adjusted under 35 U.S.C. 154(b) by 30 days.

(21) Appl. No.: 12/540,377

(22) Filed: Aug. 13, 2009

(51) Int. Cl.
*F41B 11/00* (2006.01)

(52) U.S. Cl. ..... 124/73; 124/74; 124/75; 124/76; 124/77

(58) Field of Classification Search ..... 124/73–77
See application file for complete search history.

(56) References Cited

U.S. PATENT DOCUMENTS

| | | | | |
|---|---|---|---|---|
| 7,025,052 | B2 * | 4/2006 | Schavone | 124/74 |
| 7,353,815 | B2 * | 4/2008 | Wei | 124/45 |
| 7,398,776 | B2 * | 7/2008 | Casas Salva | 124/74 |
| 7,581,954 | B2 * | 9/2009 | Schavone | 434/18 |
| 7,730,881 | B1 * | 6/2010 | Pedicini et al. | 124/65 |
| 7,784,454 | B2 * | 8/2010 | Tiberius et al. | 124/72 |
| 2007/0028911 | A1 * | 2/2007 | Chen | 124/74 |
| 2009/0235910 | A1 * | 9/2009 | Maeda | 124/52 |
| 2010/0224180 | A1 * | 9/2010 | Tippmann et al. | 124/74 |

* cited by examiner

*Primary Examiner*—Troy Chambers

(57) ABSTRACT

The present utility model relates to a gas air operated with draw back boring toy long-barrelled gun. Its firing module, ammunition box module and trigger module are installed in the main body of the gun, wherein a rifle bolt main body is provided inside the firing module, and there is a connecting rod, a piston module and a rifle bolt gearing component provided inside the rifle bolt main body. Through the trigger module, and the connecting rod, the piston module and the rifle bolt gearing component provided inside the rifle bolt main body, its trigger module produces gas air fire, and makes the firing module produces gas air draw back and automatic loading. It enables the firing module to draw back and loading automatically, and allows the gun to fire continuously.

1 Claim, 8 Drawing Sheets

GAS AIR OPERATED WITH DRAW BACK BORING TOY LONG-BARRELLED GUN

FIELD OF TECHNOLOGY

The present utility model relates to a gas air operated with draw back boring toy long-barrelled gun, especially to a kind of structural toy gun.

BACKGROUND OF THE TECHNOLOGY

Among the existing structural toy guns, there is a kind of air gun, wherein an air cylinder and piston module is provided inside the gun body, which is designed especially for children players. Through the movement of the air cylinder and the piston module, the air inside the air cylinder is compressed, and then produces a reverse direction of pressure power to fire bullets, but there are some problems existing as below:

1. unable to fire continuously: in each compression from the air cylinder and the piston module, it can only allow to fire a bullet each time. So, every time after firing a bullet, the air inside the cylinder must be compressed again for another shot action, so it cannot fire continuously.
2. the firing effect is unsatisfactory: the reverse direction of pressure power compressed by the air cylinder and the piston module is not large, so the firing effect is unsatisfactory.

SUMMARY OF THE UTILITY MODEL

The embodiment of the present utility model aims at providing a gas air operated with draw back boring toy long-barrelled gun in order to solve the problems of the unsatisfactory firing effect and the continuous ability of firing.

The gas air operated with draw back boring toy long-barrelled gun embodiment provided by the present utility model is realized by taking the following technical solutions:

The gas air operated with draw back boring toy long-barrelled gun, wherein the toy gun includes a main body of the gun, a firing module, an ammunition box and a trigger module, wherein the firing module, the ammunition box and the trigger module are located on the main body of the gun. There is rifle bolt main body provided in the firing module, wherein a connecting rod, a piston module and a rifle bolt gearing component are provided inside the rifle bolt main body. Through the trigger module, and the connecting rod, the piston module and the rifle bolt gearing component provided inside the rifle bolt main body, its trigger module produces gas air fire, and makes the firing module produces gas air draw back and automatic loading. It enables the firing module to draw back and loading automatically, and reduce the possibility of damage of the gun.

Figure 1:
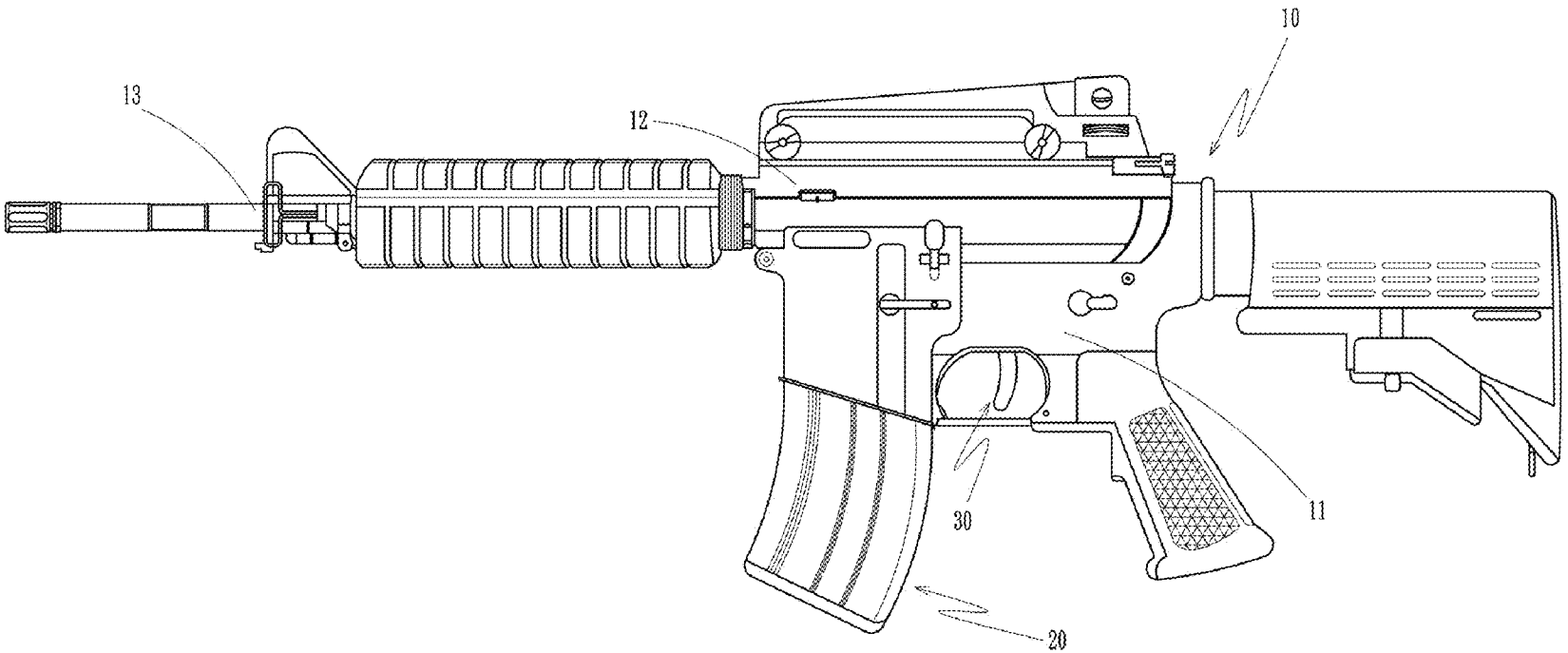
FIG. 1 is the structural scheme of the gas air operated with draw back boring toy long-barrelled gun provided by the embodiment of the present utility model (main view)

DESCRIPTION OF THE SIGNS OF THE KEY PARTS (10) the main body of the gun
(11) the barrel stand
(110) the ammunition box module combination section
(111) the trigger module installation section
(112) the firing module combination section
(12) the barrel frame section
(13) the barrel section
(20) the ammunition box module
(21) the ammunition box shell
(22) the ammunition box
(23) the warhead component
(24) the air resisting rubber
(25) the air valve
(26) the air valve connecting rod
(27) the ballistic side cover
(28) the bullet box base
(30) the trigger module
(300) the module main body
(31) the shot needle delay control piece
(32) the shot needle main body
(33) the trigger
(34) the right trigger spring
(35) the mainspring of the shot hammer
(36) the shot hammer
(37) the auxiliary hook
(38) the pull crankshaft
(39) the left trigger spring
(40) the firing module
(41) the rifle bolt main body
(410) the connecting rod
(411) the piston head
(412) the rubber piston
(413) the rifle bolt gearing component
(50) the air chamber module
(51) the air cylinder
(52) the air chamber main body
(53) the velocity modulation link
(54) the air chamber set collar
(55) the gas pole (56) the ammunition feed spray nozzle
(57) the open and shut spring coil
(58) the open and shut valve
(59) the ammunition feed spray nozzle tail hood

DETAILED DESCRIPTION OF THE EMBODIMENTS

For a better understanding the technical solutions of the present utility model, the embodiment provided by the present utility model is described in hereinafter by combining the drawings attached.

Figure 2:
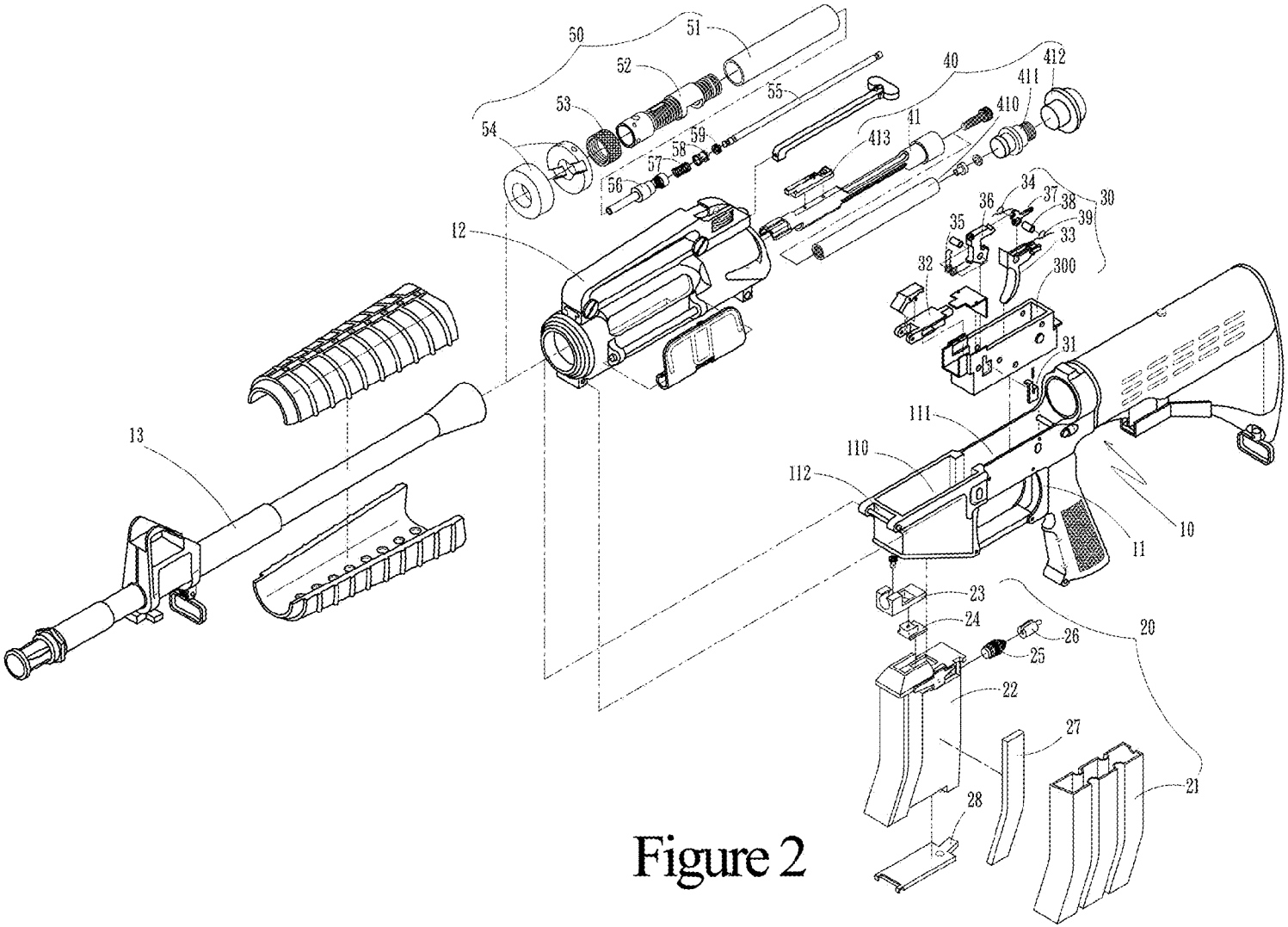
FIG. 2 is the decomposition structural scheme of the gas air operated with draw back boring toy long-barrelled gun provided by the embodiment of the present utility model (side view)
Figure 3:
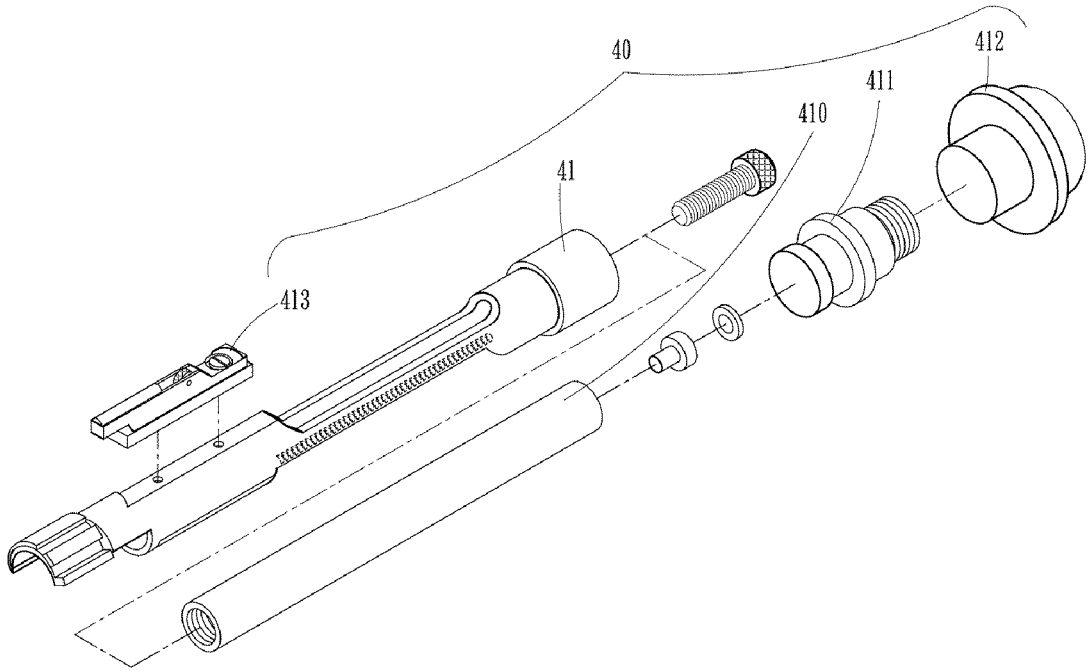
FIG. 3 is the decomposition structural scheme of the firing module of the gas air operated with draw back boring toy long-barrelled gun provided by the embodiment of the present utility model (side view)

FIGS. 1, 2 and 3 are the three-dimensional combination, decomposition and partial decomposition structural scheme drawings of this present utility model, which includes:

a main body of the gun (10), wherein a barrel stand (11), a barrel frame section (12) and a barrel section (13) are provided in the main body of the gun (10), wherein an ammunition box module combination section (110), a trigger module installation section (111) and a firing module combination section (112) are provided in the barrel stand (11). The barrel stand (11) is combined with one side of the barrel frame section (12), and the other side of the barrel frame section (12) is combined with the barrel section (13);

an ammunition box module (20), wherein an ammunition box shell (21), an ammunition box (22), a warhead component (23), an air resisting rubber (24), an air valve (25), an air valve connecting rod (26), a ballistic side cover (27) and a bullet box base (28) are provided. The ammunition box module (20) is combined and installed with the ammunition box module combination section (110) in the barrel stand (11) of the main body of the gun (10);

a trigger module (30), wherein a module main body (300), and there is a shot needle delay control piece (31), a shot needle main body (32), a mainspring of the spot hammer (35) and a shot hammer (36) provided inside the front part of the cavity of the module main body (300). Besides, there is a trigger (33), a right trigger spring (34), an auxiliary hook (37), a pull crankshaft (38) and a left trigger spring (39) are provided inside the back part of the cavity of the module main body (300). The trigger module (30) is located inside the trigger module installation section (111) of the barrel stand (11) of the main body of the gun (10);

a firing module (40), wherein a rifle bolt main body (41) is provided, wherein a connection rod (410), a piston head (411), a rubber piston (412) and a rifle bolt gearing component (413) are provided inside the rifle bolt main body (41). The firing module (40) is located inside the barrel frame section (12) of the main body of the gun (10);

an air chamber module (50), wherein an air cylinder (51), an air chamber main body (52), an velocity modulation link (53), some air chamber set collars (54), a gas pole (55), an ammunition feed spray nozzle (56), an open and shut spring coil (57), an open and shut valve (58) and an ammunition feed spray nozzle tail hood (59) are provided. The air chamber module (50) is located inside the barrel frame section (12) of the main body of the gun (10).

The gas air operated with draw back boring toy long-barrelled gun is made by the above combinations.

Figure 4:
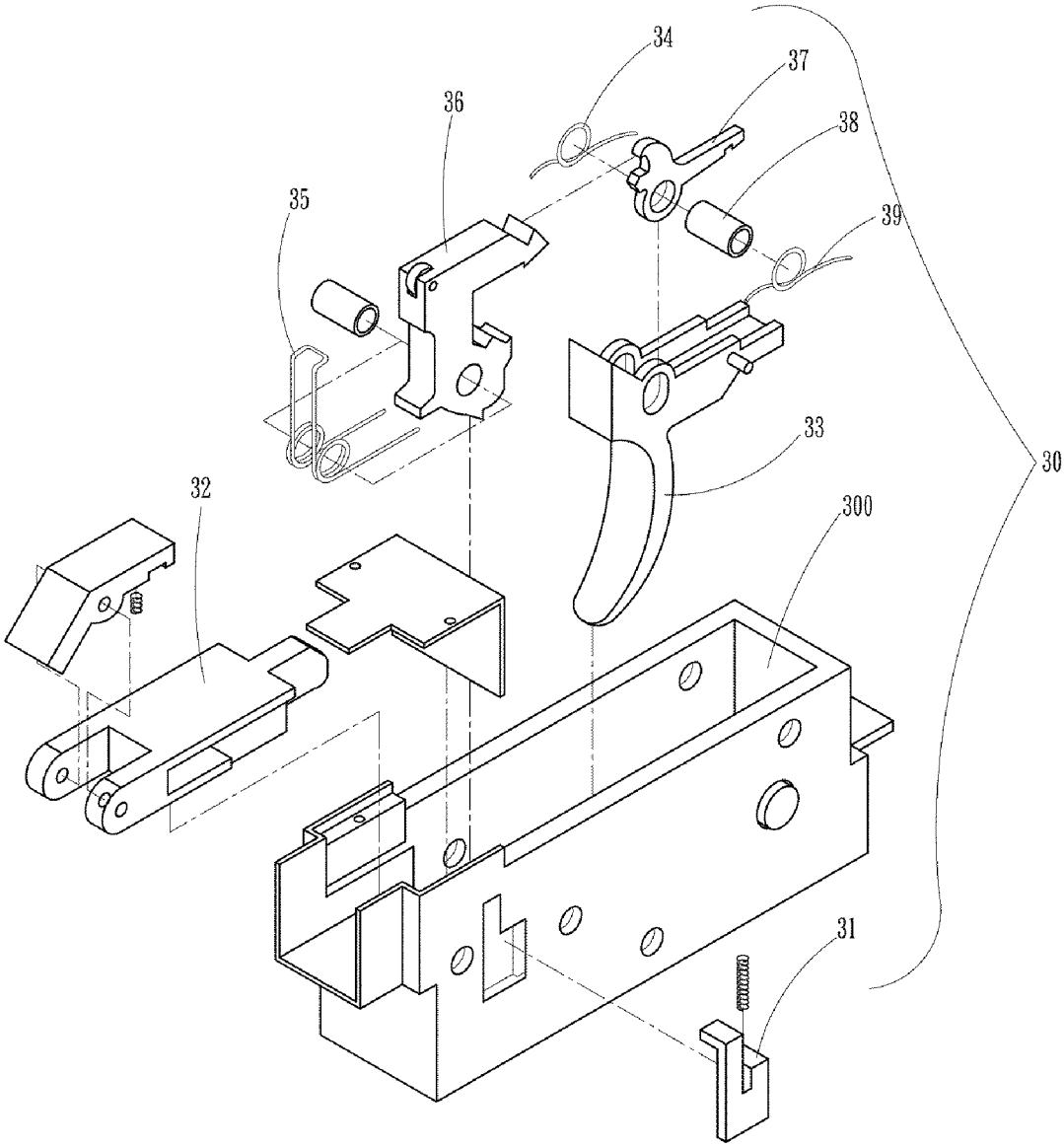
FIG. 4 is the decomposition structural scheme of the trigger module of the gas air operated with draw back boring toy long-barrelled gun provided by the embodiment of the present utility model (side view)
Figure 4A:
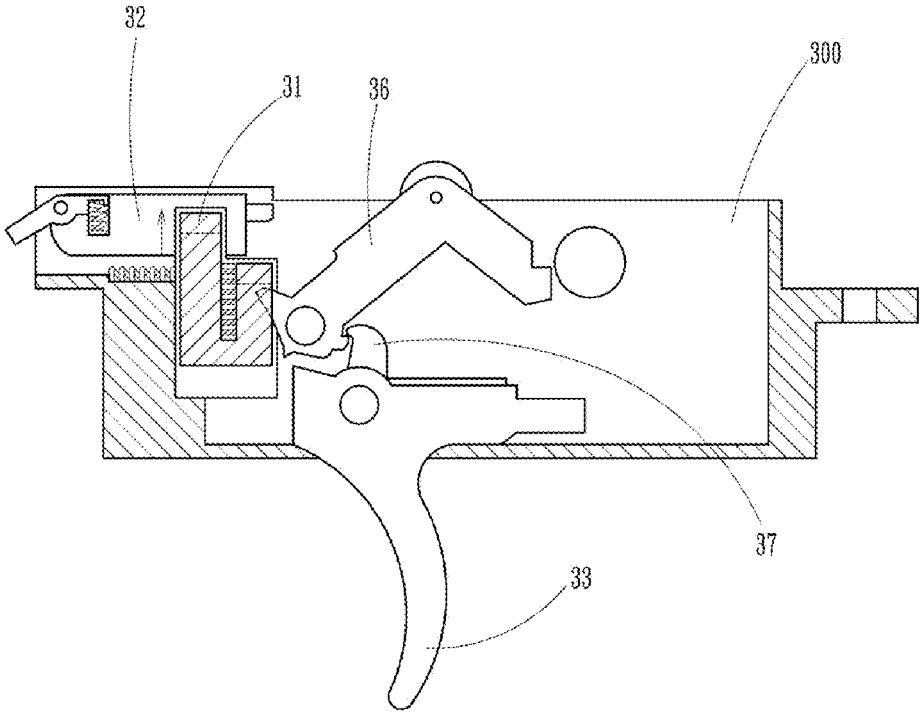
FIG. 4A is the first work schematic drawing 1 of the trigger module of the gas air operated with draw back boring toy long-barrelled gun provided by the embodiment of the present utility model (side view)
Figure 4B:
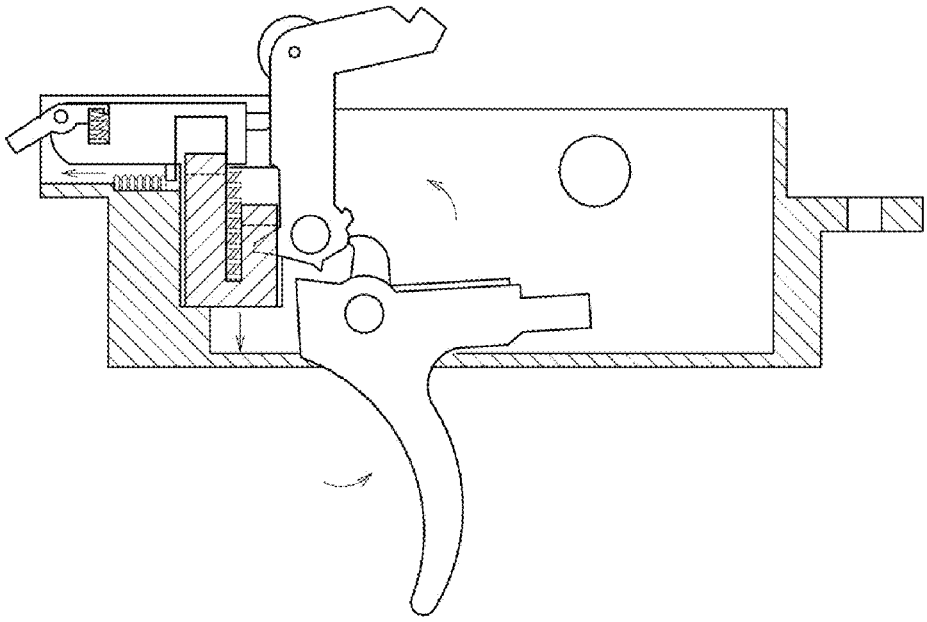
FIG. 4B is the second work schematic drawing 2 of the trigger module of the gas air operated with draw back boring toy long-barrelled gun provided by the embodiment of the present utility model (side view)
Figure 5:
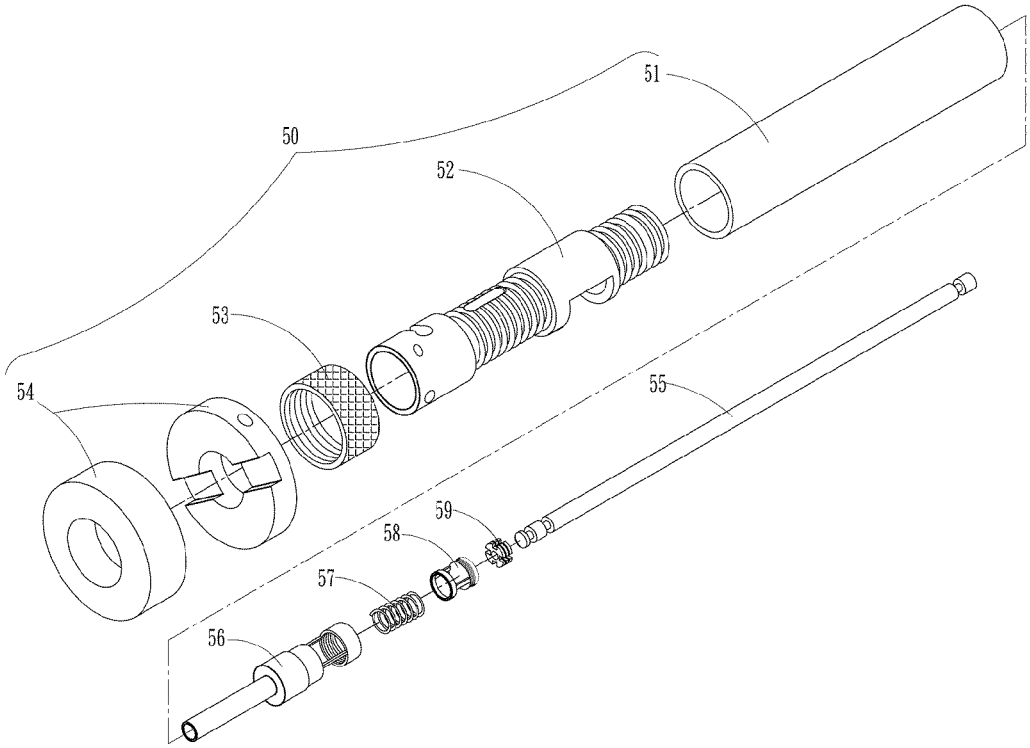
FIG. 5 is the decomposition structural scheme of the air chamber module of the gas air operated with draw back boring toy long-barrelled gun provided by the embodiment of the present utility model (side view)
Figure 6:
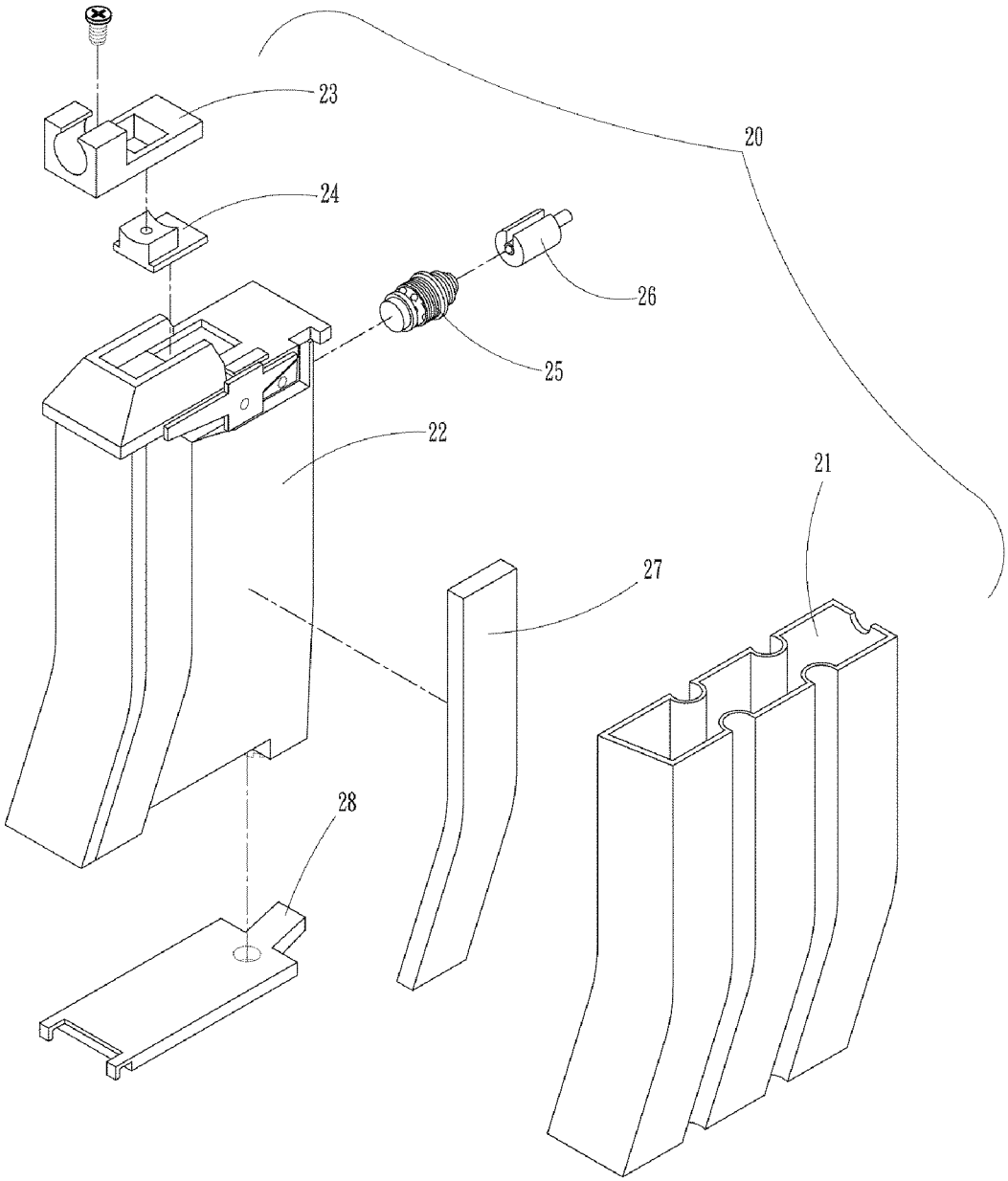
FIG. 6 is the decomposition structural scheme of the ammunition box module of the gas air operated with draw back boring toy long-barrelled gun provided by the embodiment of the present utility model (side view)
Figure 7:
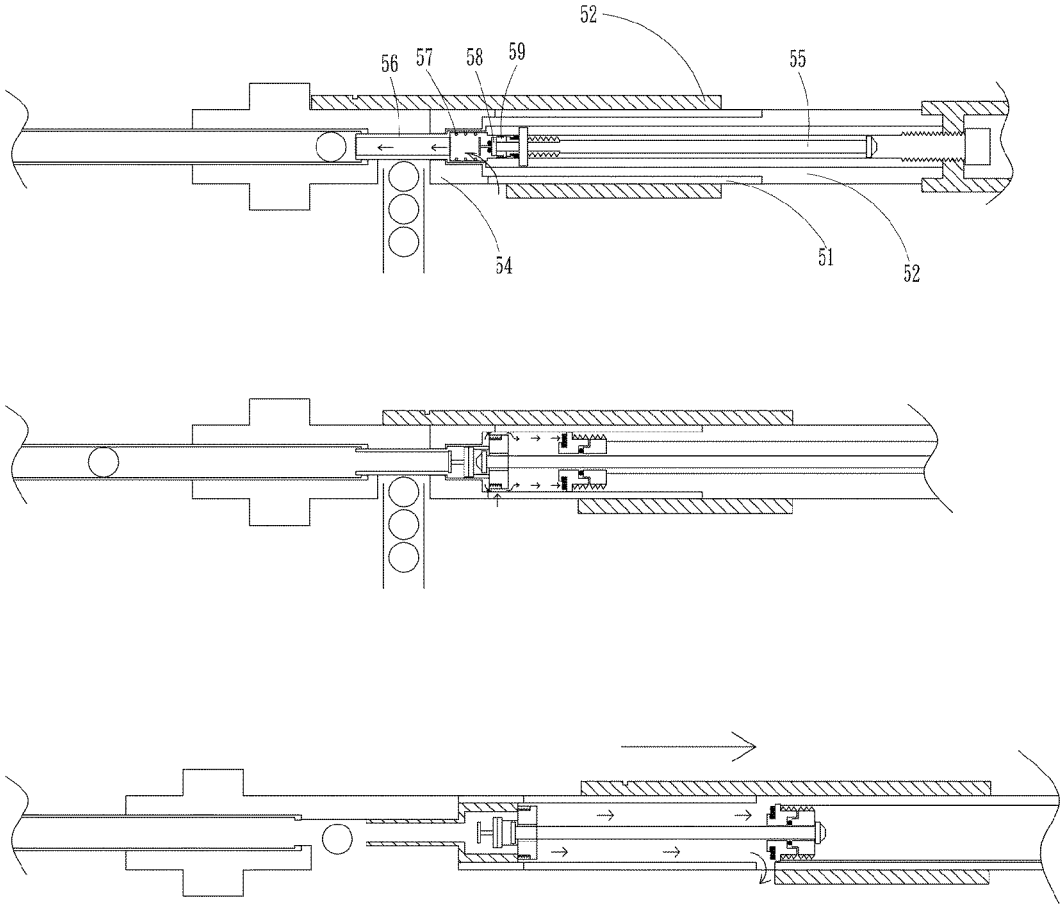
FIG. 7 is the decomposition structural scheme of the firing condition of the gas air operated with draw back boring toy long-barrelled gun provided by the embodiment of the present utility model (side view)

As shown in FIGS. 4A, 4B and 7, these are the first and second work schematic drawings of the trigger module and the firing condition drawings. When pulling the trigger (33) in the trigger module (30), the shot hammer (36) loses the blocking of the trigger (33), and the mainspring of the shot hammer (35) releases the shot hammer (36) to move forward rapidly due to the release of the pressure (not shown in the drawings) at the same time, the shot hammer (36) strikes the shot needle main body (32) when it moves forward, and the shot needle main body (32) oppresses forward to open the air valve (25) (not shown in the drawings) of the ammunition box module (20), to make the condensed air released and instantaneously enter and fully fill the drifting path inside the rifle bolt main body (41), and push the bullet forward, then it will produce airflow to make the pressure unbalance after the bullet was fired, hence to attract the open and shut air valve to close and move forward to the drifting path, after the shot needle main body (32) moves forward to a certain distance, the shot needle delay control piece (31) falls to block the shot needle main body (32) moving backward, then to make the air valve (25) open continuously to release the condensed air and store inside the air cylinder of the connecting rod (410) of the rifle bolt main body (41), the backward moves of the rifle bolt gearing component (413) oppresses the rolling wheel above the shot hammer (36), then to make the shot hammer (36) falls backward, then the rear end of the shot hammer (36) hooks on the auxiliary hook (37) on the module main body (300) of the trigger module (30), after the stress of the trigger module (30) relieves, the front end of the module main body (300) moves upwards to hook on the trench below the shot hammer (36), and because of the module main body (300), the auxiliary hook (37) at the rear end of the module main body (300) drops down, it causes the auxiliary hook (37) separated from the shot hammer (36), when the connecting rod (410) of the rifle bolt main body (41) of the air cylinder compresses, the connecting rod (410) of the rifle bolt main body (41) oppresses the rifle bolt main body (41) to slide backwards, and when it depresses the shot hammer (36) to wedge in the auxiliary hook (37) of the trigger module (300), as the diameter function of the rolling wheel above the shot hammer (36), due to the module main body (300) keep moving backwards continuously, it causes the shot hammer (36) oppressing downwards, at the same moment the prominence on the lower part of the module main body (300) acts with the shot needle delay control piece (31), the shot needle delay control piece (31) pushes upwards to release the limitations of the shot needle main body (32), the shot needle main body (32) bears from the forces of the spring and the air valve (25) and bounces back, the air valve (25) of the ammunition box module (20) closes to stop the supply of the compressed air, and the connecting rod (410), the piston head (411), the rubber piston (412) of the rifle bolt main body (41) possesses enough compressed gas to complete the whole mechanism journey, and stops the supply of the compressed gas at the predetermined mechanism action time in sequence, it can effectively ensure the movement of the machine acting completely and correctly, and the shot needle main body (32) possesses a up/down moving and a spring to provide a suitable pressure, when the shot needle main body (32) is in the stretched condition, when the ammunition box module (20) combines with the ammunition box combination section (110) of the barrel stand (11) in the main body of the gun (10), the stretch of the shot needle main body (32) does not affect or damage the air valve (25) of the ammunition box module (20), to enable the firing module to draw back and loading automatically, and reduce the possibility of damage of the gun.

The gas air operated with draw back boring toy long-barrelled gun provided by the embodiment of the present utility model is described in detail hereinbefore. As for the technical personnel generally skilled in the art, the embodiment and application scope may be changed to some extent according to the concept of the embodiment of the present utility model. Therefore, the content of the Specification does not set a limit on the present utility model.

The invention claimed is:

1. A gas air operated with draw back boring toy long-barreled gun, comprising:

a main body of the gun, wherein a barrel stand, a barrel frame section and a barrel section are provided in the main body of the gun, wherein an ammunition box, a trigger module installation section and a firing module combination section are provided in the barrel stand, the barrel stand is combined with one side of the barrel frame section, and the other side of the barrel frame section is combined with the barrel section;

an ammunition box module, wherein an ammunition box shell, an ammunition box, a warhead component, an air resisting rubber, an air valve, an air valve connecting rod, a ballistic side cover and a bullet box base are provided, the ammunition box module is combined and installed with the ammunition box combination section in the barrel stand of the main body of the gun;

a trigger module, wherein a module main body, and there is a shot needle delay control piece, a shot needle main body, a mainspring of a spot hammer and a shot hammer provided inside the front part of the cavity of the module main body, there is a trigger, a right trigger spring, an auxiliary hook, a pull crankshaft and a left trigger spring are provided inside the back part of the cavity of the module main body, the trigger module is located inside the trigger module installation section of the barrel stand of the main body of the gun;

a firing module, wherein a rifle bolt main body is provided, wherein a connection rod, a piston head, a rubber piston and a rifle bolt gearing component are provided inside the rifle bolt main body, the firing module is located inside the barrel frame section of the main body of the gun;

an air chamber module, wherein an air cylinder, an air chamber main body, an velocity modulation link, a plurality of air chamber set collars, a gas pole, an ammunition feed spray nozzle, an open and shut spring coil, an open and shut valve and an ammunition feed spray nozzle tail hood are provided, the air chamber module is located inside the barrel frame section of the main body of the gun.

* * * * *